US005687890A

United States Patent [19]

Wanner

[11] Patent Number: 5,687,890

[45] Date of Patent: Nov. 18, 1997

[54] BELT BUCKLE WITH A COMPARTMENT

[76] Inventor: Randy Lee Wanner, Box 106, Paradise, Utah 84328

[21] Appl. No.: 508,217

[22] Filed: Jul. 27, 1995

[51] Int. Cl.[6] ..... A44B 11/00

[52] U.S. Cl. ..... 224/163; 224/676; 224/245

[58] Field of Search ..... 224/163, 235, 224/676, 245; D2/624, 627, 629; 24/163 K

[56] References Cited

U.S. PATENT DOCUMENTS

| | | | |
|---|---|---|---|
| D. 271,061 | 10/1983 | Zimmerman | D2/400 |
| 726,654 | 4/1903 | Dodge | 224/163 |
| 1,163,173 | 12/1915 | Pusinelli | 224/235 X |
| 1,508,940 | 9/1924 | Sedransky | 224/235 X |
| 1,723,742 | 8/1929 | Marcus | 224/163 |
| 2,836,351 | 5/1958 | Epstein | 232/6 |
| 4,534,063 | 8/1985 | Krumin et al. | 455/344 |
| 4,562,620 | 1/1986 | Oliver, Jr. | 24/163 K |
| 4,753,377 | 6/1988 | Poluhowich | 224/163 |
| 4,942,991 | 7/1990 | Lyons | 224/245 X |
| 4,972,557 | 11/1990 | Williams | 24/163 K |
| 5,357,638 | 10/1994 | Mayzel | 2/312 |

*Primary Examiner*—Renee S. Luebke

[57] ABSTRACT

A belt buckle with a compartment includes a receptacle having an open end. The receptacle is generally cylindrical, thereby allowing a standard-sized container of smokeless tobacco to be placed in the receptacle. A spring attached within the receptacle pushes the tobacco out of the receptacle. The receptacle has a lid which has at least two grooves that engage corresponding pins attached to the receptacle. A flange is secured about the receptacle. The flange has an inner arcuate surface. A retaining hook and retaining structure are secured at opposite ends of the inner surface to permit attachment of the belt buckle to a belt.

15 Claims, 4 Drawing Sheets

BELT BUCKLE WITH A COMPARTMENT

BACKGROUND

1. The Field of the Invention

The present invention is related to a belt buckle with a compartment. More particularly, the present invention is related to a belt buckle with a cylindrical receptacle which is configured to receive and retain a standard-sized container of smokeless tobacco.

2. Technical Background

Belt buckles, which come in a variety of shapes and sizes, are mainly used to fasten belts. Although the material and specific workings of each belt buckle varies, the buckle's location in relation to the person wearing the buckle is almost always waist-high and in front of the user. This location offers convenient access by the user. Additionally, belt buckles, by virtue of their function, are almost always with the user. Unlike wallets, which can be set aside and misplaced, belt buckles are an integral part of the user's clothing. These two features may have led to the use of the belt buckle for other purposes such as storing various items.

Combinations of storage devices and belt buckles are useful for storing or hiding items that the user of the buckle wishes to keep secret. Combination belt buckles also offer an alternative to pant pockets when storing sharp objects or objects that may damage the pocket material. The combination belt buckles existing today, however, have several drawbacks.

One disadvantage of known combination belt buckles is that the storage area within the belt buckle is configured to receive and retain only one particular item. For example, some belt buckles can only hold a specific type of coin which is press fit into the buckle. Items other than coins, or even other coins of different diameters, will not be retained by the storage device. Still other belt buckle storage devices have slots or other openings and are not capable of securely storing items that are smaller than these openings. Thus, the storage capability of these belt buckles is not fully utilized.

Other belt buckles provide no way to displace an item lodged within the storage compartment of the belt buckle. The close fit of some items within the storage compartment reduces rattle, but also makes these items difficult to remove. For example, if the perimeter of a stored item closely matches the perimeter of the storage compartment, it can be difficult for the user to grasp the stored item with his or her fingers. In this situation, the user often has to remove the entire belt to coax out the contents of the buckle. This limitation hinders the belt buckle's utility for storing items.

Finally, one disadvantage of many combination belt buckles is that they do not resemble traditional belt buckles. It is often advantageous to conceal the fact that the belt buckle is being used to store something. This is best accomplished by disguising the storage capability of the belt buckle or at least making the storage capability unobvious to a casual observer. Many existing combination belt buckles simply have a bracket or other holding device into which the item to be stored is placed. The item remains visible to casual observers. Other belt buckles may conceal the object being stored, but the configuration of the belt buckle makes the existence of a storage compartment obvious even to casual observers. For example, some combination belt buckles merely consist of a pouch attached to a belt.

From the foregoing, it will be appreciated that it would be an advancement in the art to provide a belt buckle with a compartment such that the belt buckle maintains the look of traditional belt buckles.

It would be a further advancement in the art if the belt buckle had a compartment that could accommodate items of various sizes.

It would be an additional advancement in the art if the compartment were configured to urge its contents out of the compartment when the compartment is opened.

Such a belt buckle with compartment is disclosed and claimed herein.

BRIEF SUMMARY AND OBJECTS OF THE INVENTION

The present invention is directed to a novel belt buckle. In a presently preferred embodiment, the buckle includes a substantially cylindrical receptacle having an open end. The receptacle is configured with a spring for pushing the contents of the receptacle toward the open end. The receptacle is also configured to receive a standard-sized container of smokeless tobacco.

The belt buckle has a lid with an annular lip configured to fit closely over the open end of the receptacle. A plurality of L-shaped locking grooves are disposed within the annular lip and a corresponding plurality of pins are attached about the exterior surface of the receptacle adjacent the open end for engaging the locking grooves. When the lid is positioned for locking engagement with the receptacle, each pin is slidable within one of the respective grooves from a first end of the groove to a locked end of the groove, thereby securing the lid to the receptacle. The locked end of each L-shaped groove has a notch in which the corresponding pin rests when the lid is in the secured position.

A flange is secured about the receptacle. The flange is curved and has an inner arcuate surface. A retaining hook is secured at one end of the inner arcuate surface and a retaining structure is secured at the opposite end of the inner arcuate surface, thereby providing a way to secure the belt buckle to a belt.

The advantages of the present invention will become more fully apparent by examination of the following description of the preferred embodiments and the accompanying drawings.

BRIEF DESCRIPTION OF THE DRAWINGS

To better understand the invention, a more particular description of the invention will be rendered by reference to the appended drawings. These drawings only provide information concerning typical embodiments of the invention and are not to be considered limiting of its scope. The invention will be described and explained with additional specificity and detail through the use of the accompanying drawings, in which.

DETAILED DESCRIPTION OF THE PREFERRED EMBODIMENTS

Figure 1:
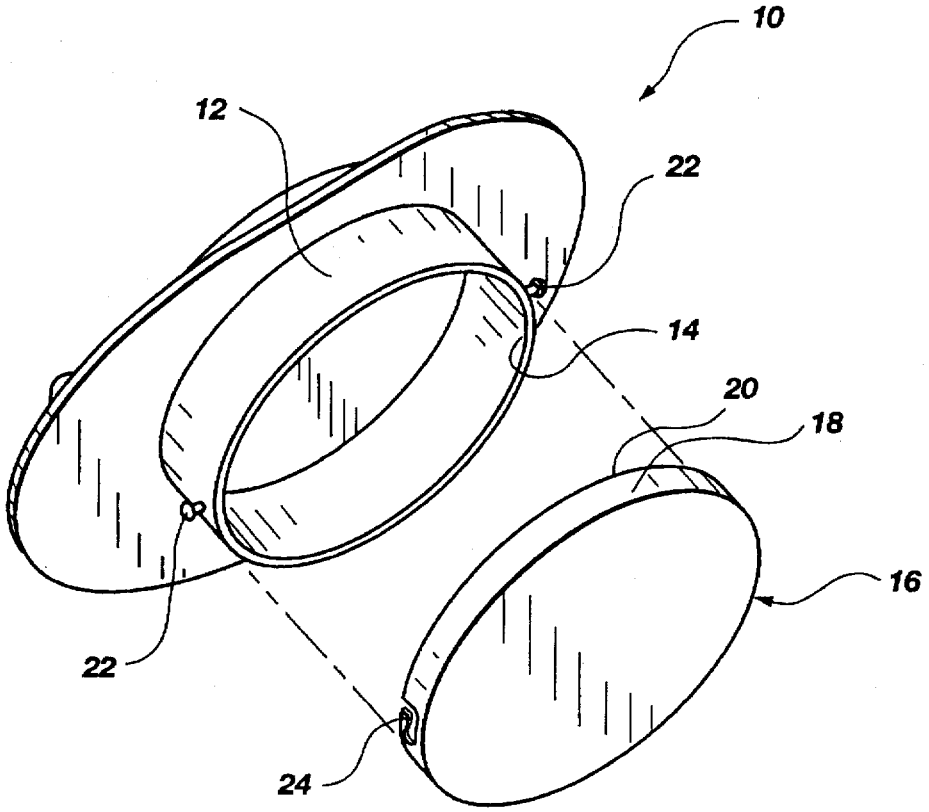
FIG. 1 is a perspective view of one embodiment of a compartmented buckle according to the present invention.

Reference is now made to the figures wherein like parts are referred to by like numerals throughout. With particular reference to FIG. 1, a belt buckle with compartment according to the present invention is generally designated at 10. The belt buckle 10 includes a preferably cylindrical receptacle 12.

The receptacle 12 has open end 14. The walls of the receptacle 12 form a substantially continuous ring to which the bottom of the receptacle 12 is attached. In some embodiments, the ring and bottom are initially separate pieces that are welded or glued together to form the receptacle. In other embodiments, the receptacle 12 is formed as a single integral piece.

A lid 16 is provided to fit over the open end 14 of the receptacle 12. When the lid 16 engages the open end 14 of the receptacle 12, a chamber within the receptacle 12 is substantially fully enclosed. In a presently preferred embodiment there are no openings in the lid or in the ring-shaped walls or base of the receptacle, so the interior chamber defined by the receptacle and lid is fully enclosed. Thus, items of various sizes may be stored within the receptacle 12 without falling out.

The receptacle 12 of the preferred embodiment is configured to receive a conventional standard-sized container of smokeless tobacco. However, it will be appreciated that the receptacle 12 need not be cylindrical to hold a container of smokeless tobacco. A variety of receptacle 12 shapes will hold containers of smokeless tobacco if configured with dimensions readily determined by those of skill in the art. Suitable shapes include octagons, squares, and diamonds. It will further be appreciated that the contents of the tobacco container may be transferred from the container into the receptacle 12, thereby eliminating the need to store the container. Although the preferred embodiment is configured to hold smokeless tobacco, this and other embodiments may of course also be used to hold other items.

With continued reference to FIG. 1, the belt buckle with compartment 10 also includes a lid 16 that is configured to releasably engage the open end 14 of the receptacle 12. In the presently preferred embodiment, the lid 16 includes an annular lip 18 having a leading edge 20. The lip 18 is configured to fit closely over the open end 14 of the receptacle 12.

In an alternative embodiment, the lid has an annular lip that fits closely within the open end 14 of the receptacle 12 rather than fitting around the outside of the receptacle 12. Those of skill will appreciate that the lip 18 shown is annular because the receptacle 12 is cylindrical. In alternative embodiments having octagonal, square, or other shaped receptacles, the lid has a corresponding octagonal, square, or other shape. The teachings of this invention can also be practiced with a variety of lid shapes given a particular shape of receptacle 12.

One will further appreciate that the lid 16 may be releasably secured to the receptacle 12 without the lip 18, or that the perimeter of the lid may extend beyond the lip. In either case, it becomes unnecessary for the shape of the lid to exactly match the shape of the receptacle 12.

Figure 2:
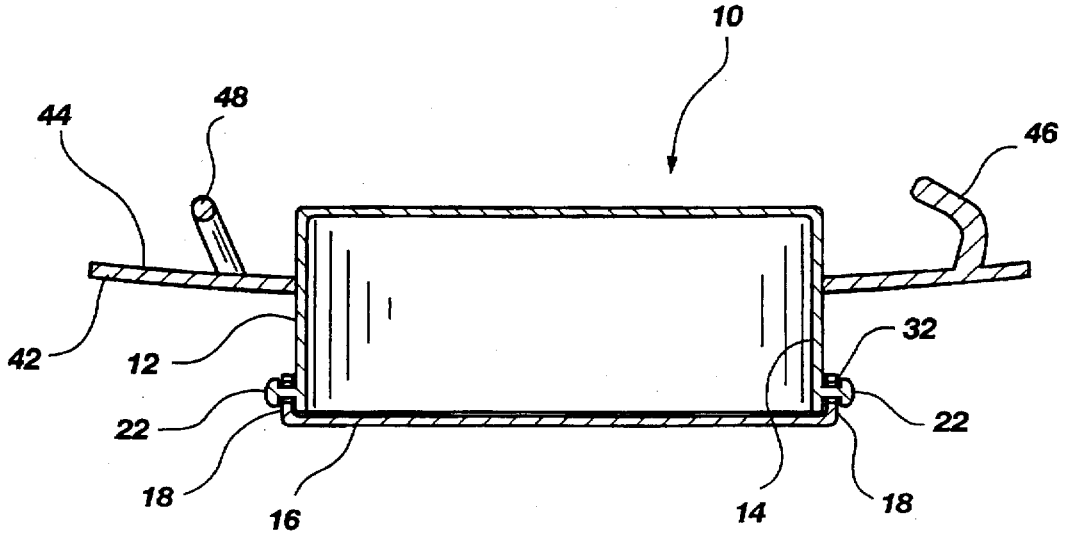
FIG. 2 is side cross-sectional view of the buckle showing means for attaching the lid to the receptacle.
Figure 3:
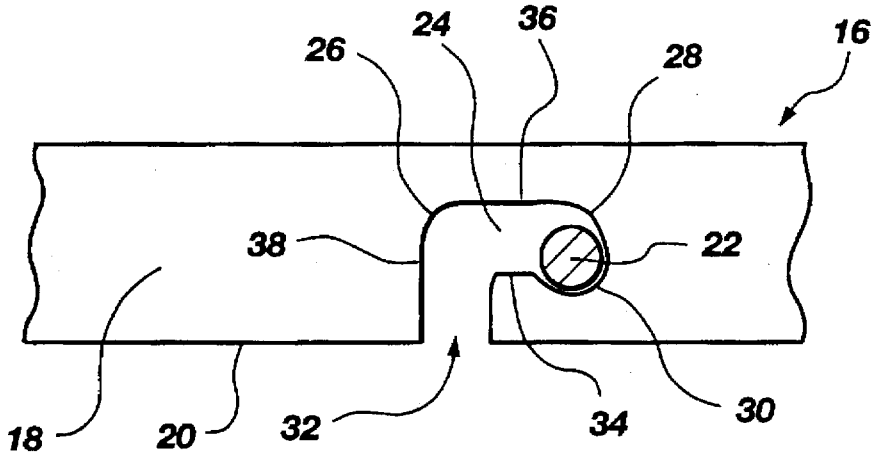
FIG. 3 is a partial side view of the lid of the belt buckle showing cross-section of an attachment pin positioned in an L-shaped locking groove.

Referring now to FIGS. 1, 2 and 3, a currently preferred means for securing the lid 16 to the receptacle 12 is illustrated. A plurality of pins 22 is attached about the open end 14 of the receptacle 12. A corresponding plurality of L-shaped locking grooves 24 is disposed within the annular lip 18 of the lid 16 for locking engagement with the pins 22.

Each locking groove 24 has a first end 26 and a locked end 28 which define a first portion 36 of the L-shaped locking groove 24. The first portion 36, which is substantially parallel to the leading edge 20 of the lip 18, includes a forward wall 34. A second portion 38 of each L-shaped locking groove 24 extends away from the first portion 36 toward the leading edge 20 of the lip 18 adjacent the first end 26 of the locking groove 24. The second portion 38 and the first portion 36 are substantially perpendicular to each other, thereby defining an L-shape.

The second portion 38 of the locking groove 24 is disposed through the leading edge 20 of the lip 18, thereby creating an opening 32. The several openings 32 of the plurality of locking grooves 24 are spaced about the lip 18 of the lid 16 in positions corresponding to the spacing of the pins 22 about the open end 14 of the receptacle 12.

In alternative embodiments, the first portion 36 of the locking groove 24 does not substantially parallel the leading edge 20 of the lip 18. In such embodiments, the first 36 and second 38 portions of the groove 24 are not substantially perpendicular to one another. Instead, the angle between the first 36 and second 38 portions is less than ninety degrees, thereby assisting in holding the lid on.

With reference to FIG. 3, the locked end 28 of each locking groove 24 includes a notch 30 in which a respective pin 22 rests when the lid 16 has been secured to the receptacle 12. The notch 30 extends slightly beyond the forward wall 34 of the grove 24 in the direction of the leading edge 20 of the lip 18. Thus, the bottom of the notch 30 is slightly offset from the locking groove 24.

When the pin 22 is resting within or otherwise abutting the bottom of the notch 30, the distance from the pin 22 to the leading edge 20 is therefore less than the distance from the forward wall 34 to the leading edge 20. Thus, the pin 22 is inhibited from sliding through the groove 24. The notch 30 helps maintain the lid 16 in a secured or locked position with respect to the receptacle 12 by preventing the pins 22 from sliding from the locked end 28 of the groove 24 to the first end 26 where the pins 22 could pass through the opening 32 and free the lid 16 from the receptacle 12.

Although the illustrated locking grooves 24 have substantially linear sides, in other embodiments the locking groove sides have other shapes. Suitable locking groove sides include sides which are configured with multiple notches, thereby increasing the degree of security with which the lid is attached to the receptacle.

The pins 22 are maintained in contact with a respective notch 30 in a variety of ways. In one embodiment, an outward force is exerted upon the attached lid 16, thereby urging it away from the bottom of the receptacle 12. As the lid 16 with the attached lip 18 and L-shaped locking groove 24 is urged outward each notch 30 comes to abut a respective pin 22. Each pin 22 is thereby positioned at the locked end 28 and substantially fixed in position with respect to the lid 16.

Unless and until this outward force is neutralized by a force in the opposite direction, each pin 22 will remain in its respective notch 30, slightly offset from, and unable to slide through, the groove 24. In one embodiment discussed below, a biasing means urges the contents of the receptacle 12 toward the open end 14 of the receptacle 12 and against the lid 16 secured to the receptacle 12, thereby creating the outward force on the lid 16.

In a preferred embodiment the positioning of the pins 22 about the receptacle 12 and the positioning of the grooves 24 in the lip 18 helps maintain the pins 22 in contact with their respective notches 30. The pins 22 are positioned about the receptacle 12 at predetermined distance(s) from the edge of the opening 14. The locking grooves 24 are disposed within the lip 18 at corresponding distance(s) from the leading edge 20 of the lip 18.

When the openings 32 within the lip 18 are positioned over the corresponding pins 22, the pins 22 and grooves 24 mate and the pins travel through the second portion 38 of the grooves 24. The pins 22 then travel through the first portion 36 of the grooves 24 as the lid 16 is rotated.

In some embodiments the pins 22 engage the forward walls 34 of the grooves 24 as the pins 22 travel through the first section 36 of the grooves 24. This engagement creates a force that is only partially relieved when each pin 22 reaches the notch 30 at the locked end 28 of the groove 24. Without applying a force to the lid 16 greater than the force created by the interaction of each pin 22 with its respective forward wall 34, the pins 22 will not be able to pass through the grooves 24 and will remain in their respective notches 30.

It will be appreciated that the amount of force created by the interaction of pins 22 and the forward wall 34 of the grooves 24 may be varied. The strength of the force may be controlled by varying the depth of the grooves 24 within the lip 18, the depth of the pins 22 about the receptacle 12, or the strength of the biasing force created by a structure 54 (FIG. 6) that is ultimately responsible for producing the outward force described above. Accordingly, the amount of user-applied force necessary to remove the lid may also be varied.

To secure the lid 16 to a receptacle 12, each opening 32 is positioned over a respective pin 22. The lid 16 is pushed toward the bottom of the receptacle 12 and then rotated with respect to the receptacle 12. As the lid 16 rotates, each pin 22 slides within its respective groove 24 from the first end 26 of the groove 24 to the locked end 28 of the groove 24. The lid 16 is rotated until the pins 22 abut the locked end 28 of their respective grooves 24.

In one embodiment, the user must supply a twisting force sufficient to overcome the force of friction present when the pins 22 engage the forward wall 34 of a respective groove 24. In an embodiment where an outward force is exerted upon the lid, the user must provide an opposing inward force to the lid 16 as it is placed over the receptacle 12 to move the pins 22 into the first portion 36 of the groove 24. The user must then maintain the applied inward force while rotating the lid 16 until each pin 22 abuts the locked end 28. As the user releases the lid 16, the outward force urges each pin 22 into its respective notch 30. Although the illustrated embodiment utilizes clockwise rotation for locking the lid 16 and counter-clockwise rotation for releasing the lid 16, other embodiments swap these roles.

It will be appreciated that various groove 24 configurations may be utilized to secure the lid 16 to the receptacle 12. Additionally, the teachings of this invention may be practiced with pins of various cross-sectional shapes, including oval, square, diamond, or other polygonal shapes.

Figure 6:
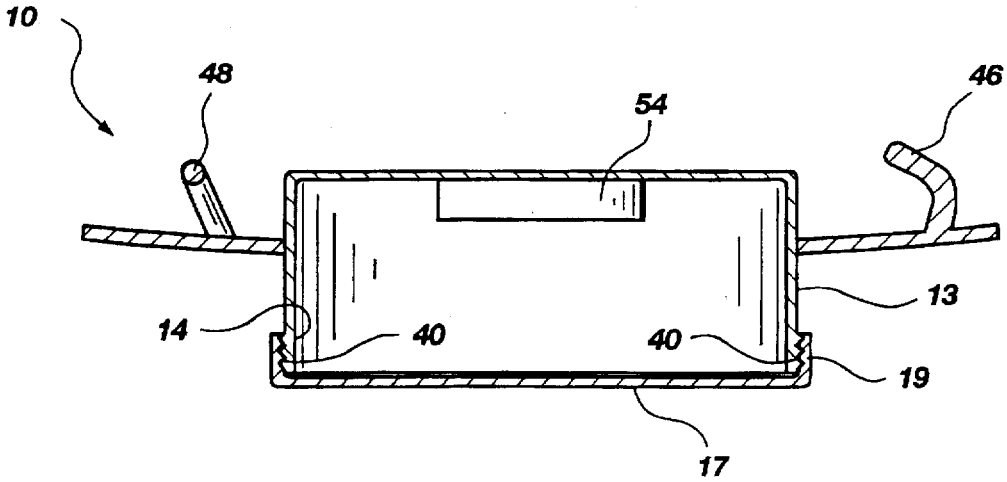
FIG. 6 is a side cross-sectional view of an alternative embodiment of the belt buckle showing an alternative means for attaching the lid to the receptacle and also showing a biasing structure for pushing the contents of the receptacle out of the belt buckle.

It will further be appreciated that the lid 16 may be secured to the receptacle 12 using a variety of means other than pins and grooves. One such alternative means is illustrated in FIG. 6. At least a portion of the open end 14 of an alternative receptacle 13 is threaded to receive corresponding threads 40 configured on at least a portion of an annular lip 19 of an alternative lid 17. The user of this embodiment screws the lid 17 down onto the receptacle 13, thereby securing the lid 17 in place. In other embodiments, the lid is releasably secured to the receptacle by a hinge or by a latch mechanism.

Figure 4:
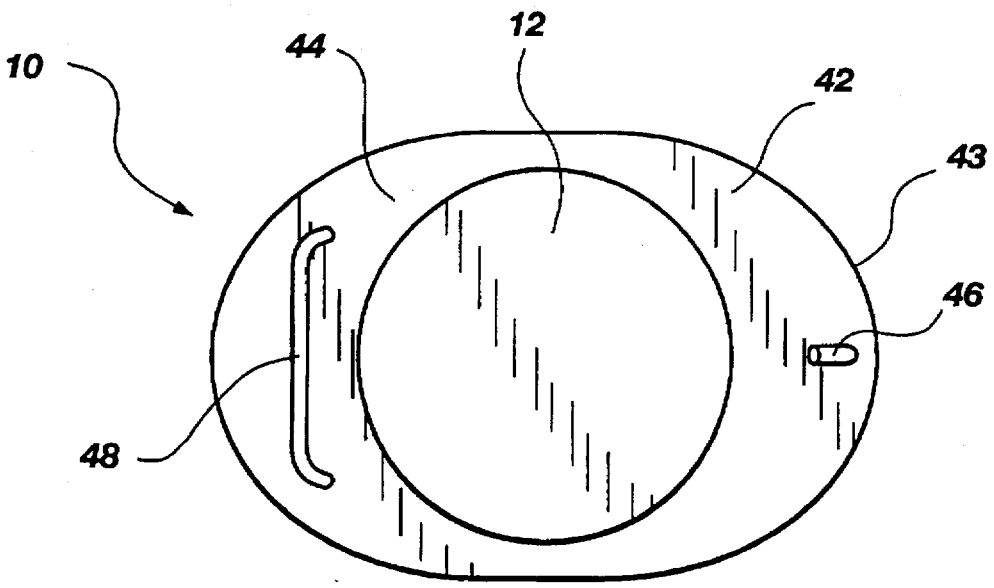
FIG. 4 is a back view of the belt buckle showing means for attaching the buckle to a belt.
Figure 5:
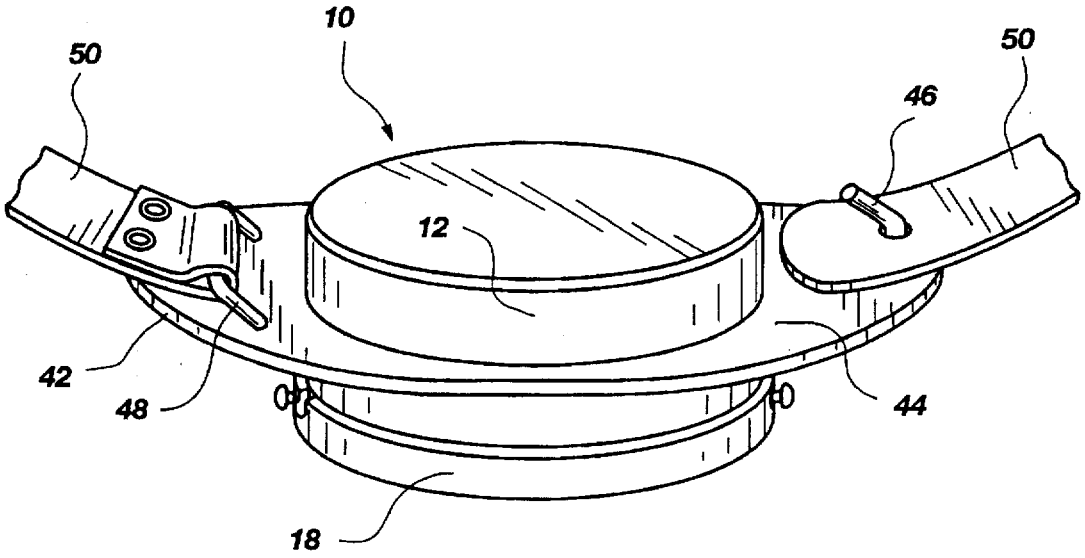
FIG. 5 is a perspective view showing the back of the belt buckle a attached to a belt.

Referring now to FIGS. 2, 4 and 5, the belt buckle with compartment 10 includes a flange 42 secured about the receptacle 12. The preferred embodiment of FIG. 2 illustrates the flange 42 secured to the lower third of the receptacle 12. In alternative embodiments, the flange is secured at other locations about the receptacle 12. The flange 42 gives the belt buckle with compartment 10 the look of traditional, non-storage belt buckles.

As shown in FIG. 2, the flange 42 includes an inner arcuate surface 44. Although other embodiments of this invention include a straight flange, the curved flange 42 in the belt buckle with compartment 10 is preferred because it more closely resembles traditional belt buckles when viewed by casual observers. The flange 42 has a substantially oval-shaped outer perimeter 43, as can be seen by reference to FIG. 4, to further enhance the visual resemblance of the belt buckle with compartment 10 to traditional belt buckles.

It will be appreciated that the flange 42 can be configured in a variety of shapes to resemble traditional belt buckles. Most notable of the alternative flange shapes resembling traditional belt buckles are the substantially rectangular flange and the diamond-shaped flange.

As illustrated in FIGS. 2, 4, and 5, the flange 42 includes a retaining hook 46 secured at one end of the inner arcuate surface 44 of the flange 42. The flange 42 also includes a retaining structure 48 secured at an opposite end of the inner arcuate surface 44 of the flange 42. As illustrated in FIG. 5, the structure 48 facilitates attachment of the belt buckle with compartment 10 to a belt 50. One end of the belt 50 is secured in a loop about the retaining structure 48.

The belt 50 is then secured about the user by positioning the retaining hook 46 within a hole punched through the belt 50 near the other end of the belt 50. It will be appreciated that a variety of other means may be attached to the flange to secure the belt buckle with compartment 10 to the belt, such as looping the belt 50 through a slot in an alternative flange instead of through the retaining structure 48. It will further be appreciated that belt attachment means may be attached directly to the receptacle 12 itself, rather than being attached to the flange 42.

With reference now to FIGS. 2 and 5, each end of the inner arcuate surface 44 of the flange 42 curves away from the open end 14 of the receptacle 12. Because the retaining hook 46 and the retaining structure 48 are attached to the inner arcuate surface 44 of the flange 42, the open end 14 of the receptacle 12 faces away from a user when the belt buckle with compartment 10 is attached to the belt 50 and worn by the user.

In alternative embodiments, the open end faces the user when the belt buckle is worn. That is, the open end is located at the opposite end of the receptacle from the embodiment shown in FIG. 5. Such alternative embodiments make the contents of the receptacle less accessible because the lid is positioned against the user and cannot be as easily removed. It may even be necessary to undo the belt to remove the lid. However, such embodiments also conceal the storage compartment more fully from casual observers, thereby maintaining the look of traditional belt buckles.

With reference now to FIG. 6, an alternative receptacle 13 includes a biasing means 54 for urging an object contained within the receptacle 13 toward the open end 14 of the receptacle 13. In this embodiment, items that match the inner contour of the receptacle 13 and which might have a propensity to become lodged within the receptacle 13 are easily removed.

For example, in one embodiment the receptacle 13 is configured to receive a standard container of smokeless tobacco. Because the circumference of the container is only slightly less than the circumference of the cylindrical receptacle 13, friction between the outer wall of the container and the inner wall of the receptacle 13 would make it difficult to remove the container from the receptacle 13. It is also difficult to grasp the container given the closeness of the surrounding receptacle 13 wall.

However, the biasing force of the biasing means 54 is sufficient to overcome the force of friction between the container of smokeless tobacco and the inner wall of the receptacle 13, thereby simplifying the removal of the container from the receptacle 13. The biasing means 54 also eliminates the difficult task of grasping the container of smokeless tobacco while it is still completely within the receptacle 13. Although the biasing means 54 is illustrated in connection with the alternative lid 17, the biasing means 54 may also be used in other embodiments, including without limitation the embodiment shown in FIG. 2.

Figure 7:
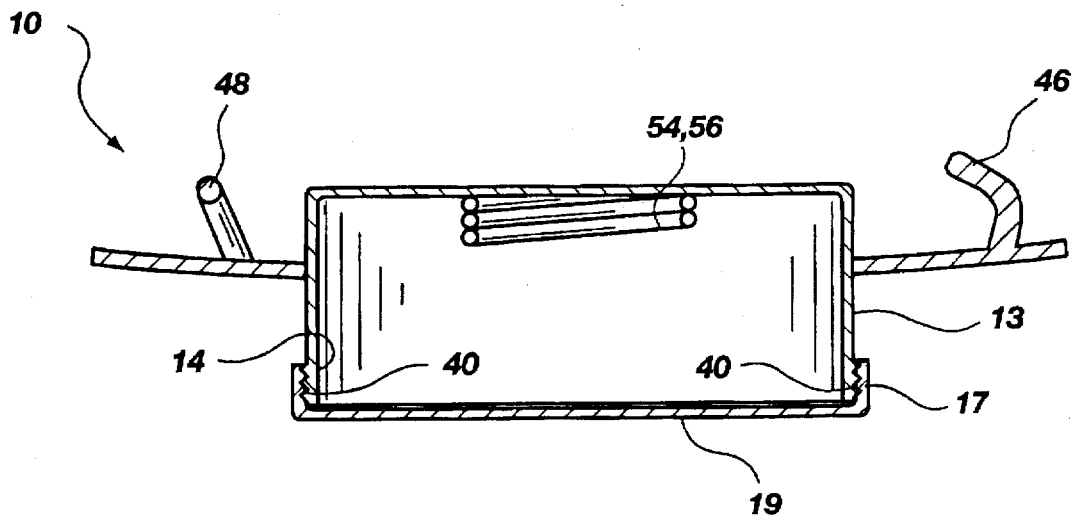
FIG. 7 is a side cross-sectional view, as shown in FIG. 6, in which the biasing structure includes a spring.
Figure 8:
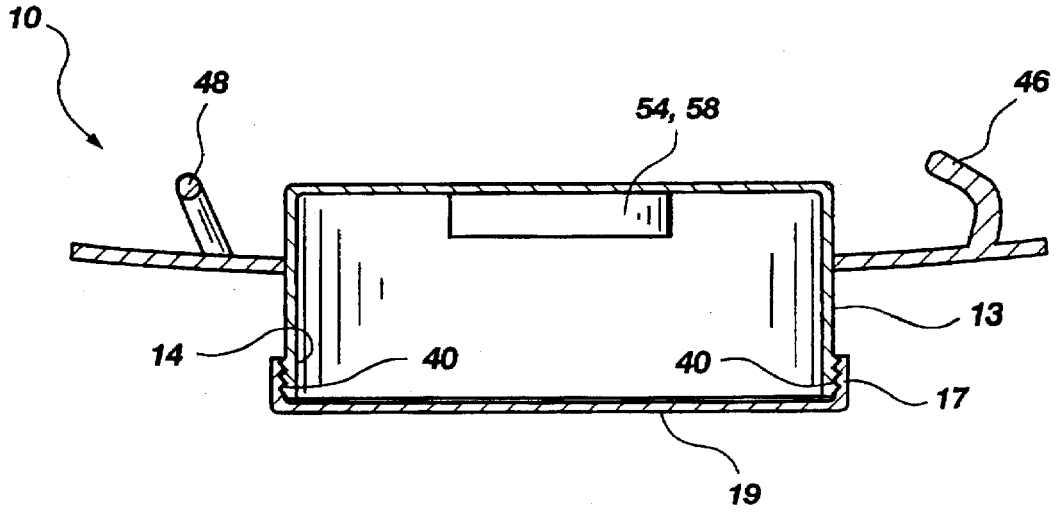
FIG. 8 is a side cross-sectional view, as shown in FIG. 6, in which the biasing structure includes foam rubber.

It will be appreciated that the contents of the receptacle 13 can be pushed out of the receptacle 13 using various biasing means 54. For example, in the embodiment shown in FIG. 7 the biasing means 54 includes a spring 56 secured to the bottom of the receptacle 13. In the embodiment shown in FIG. 8, the biasing means 54 includes foam rubber 58 elastic material that is cut to fit within the receptacle 13 and is attached within the receptacle 13. Suitable elastic materials include, but are not limited to, sponges and foam rubber.

As the spring or elastic material of the biasing means 54 compresses under the inward force of the contained items exerted by the lid 17, energy is stored. When the force is removed by the removal of the lid 17, the biasing means 54 expands using the stored energy, thereby urging the contents of the receptacle 13 out of the receptacle 13.

One embodiment of the belt buckle with compartment 10 is made of aluminum. It will be appreciated, however, that the belt buckle with compartment may be made from a number of other materials including different metals, steel, plastic, ceramic materials, composite materials, wood, or combinations thereof.

In summary, and with reference FIG. 5, the present invention provides a belt buckle with compartment 10 for unobtrusively and conveniently storing items. The buckle 10 is used by attaching the retaining structure 48 to one end of the belt 50. The belt is then positioned about the user and the retaining hook 46 is positioned within a hole in the belt 50. Items can be stored in the compartment by removing the lid 16, placing the items within the receptacle 12, and replacing the lid 16.

With reference to FIGS. 1 and 6, the belt buckle 10 of the present invention provides a compartment whose contents are easily accessible and which can completely contain items of various sizes. The compartment of the present invention uses the biasing means 54 to move stored objects out of the compartment, thereby making removal of the objects easier. Additionally, the flange 42 helps the belt buckle 10 of the present invention maintain the look of traditional belt buckles.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A belt buckle, comprising:

a receptacle having an open end;

a lid configured to releasably engage the open end, such that when the lid engages the open end a chamber within the receptacle is substantially fully enclosed;

a flange secured about the receptacle; and biasing means attached within the receptacle for urging an object contained within the receptacle toward the open end of the receptacle, wherein a plurality of pins are attached to the receptacle adjacent the open end of the receptacle and a corresponding plurality of L-shaped locking grooves are disposed within the lid such that when the lid is positioned for locking engagement with the receptacle, each pin is slidable within one of the respective grooves from a first end of the groove to a locked end of the groove to secure the lid to the receptacle.

2. A belt buckle as described in claim 1, wherein the locked end of each L-shaped groove has a notch in which the corresponding pin rests when the lid is secured to the receptacle.

3. A belt buckle, comprising:

a receptacle having an open end;

a lid configured to releasably engage the open end, such that when the lid engages the open end a chamber within the receptacle is substantially fully enclosed;

a flange secured about the receptacle; and biasing means attached within the receptacle for urging an object contained within the receptacle toward the open end of the receptacle, wherein the receptacle comprises a cylinder.

4. A belt buckle as described in claim 3, wherein the cylinder comprises a threaded portion configured to receive a corresponding threaded portion of the lid.

5. A belt buckle, comprising:

a receptacle having an open end;

a lid configured to releasably engage the open end, such that when the lid engages the open end a chamber within the receptacle is substantially fully enclosed;

a flange secured about the receptacle, the flange comprising an inner arcuate surface;

biasing means attached within the receptacle for urging an object contained within the receptacle toward the open end of the receptacle; and a retaining hook secured at a first end of the inner arcuate surface of the flange and a retaining structure secured at an opposite end of the inner arcuate surface of the flange.

6. A belt buckle as described in claim 5, wherein the first end of the arcuate surface of the flange and the opposite end of the arcuate surface of the flange each curve away from the open end of the receptacle.

7. A belt buckle, comprising:

a receptacle having an open end;

a lid configured to releasably engage the open end, such that when the lid engages the open end a chamber within the receptacle is substantially fully enclosed;

a flange secured about the receptacle; and biasing means attached within the receptacle for urging an object contained within the receptacle toward the open end of the receptacle, wherein the biasing means comprises foam rubber.

8. A belt buckle, comprising:

a receptacle having an open end;

a lid configured to releasably engage the open end, such that when the lid engages the open end a chamber within the receptacle is substantially fully enclosed;

a flange secured about the receptacle; and biasing means attached within the receptacle for urging an object contained within the receptacle toward the open end of the receptacle, wherein the receptacle is configured to receive a standard-sized container of smokeless tobacco.

9. A belt buckle comprising:

a receptacle having an open end, the receptacle comprising a cylinder;

a plurality of pins attached to the receptacle adjacent the open end of the receptacle;

a lid configured to releasably engage the open end, a plurality of L-shaped locking grooves corresponding to the plurality of pins being disposed within the lid such that when the lid is positioned for locking engagement with the receptacle each pin is slidable within one of the respective grooves from a first end of the groove to a locked end of the groove to secure the lid to the receptacle;

a flange secured about the receptacle; and biasing means attached within the receptacle for urging an object contained within the receptacle toward the open end of the receptacle.

10. A belt buckle as described in claim 9, wherein the locked end of each L-shaped groove has a notch in which the corresponding pin rests when the lid is secured to the receptacle.

11. A belt buckle as described in claim 9 wherein the lid includes an annular lip, the plurality of L-shaped locking grooves being disposed within the lip.

12. A belt buckle as described in claim 11, wherein the lip is configured to fit closely over the open end of the receptacle.

13. A belt buckle as described in claim 9, wherein the flange comprises an inner arcuate surface.

14. A belt buckle as described in claim 13, further comprising a retaining hook secured at one end of the inner arcuate surface of the flange and a retaining structure secured at an opposite end of the inner arcuate surface of the flange, each end of the arcuate surface of the flange curving away from the open end of the receptacle.

15. A belt buckle as described in claim 9, wherein the biasing means comprises a spring.

* * * * *